US007324771B2

(12) United States Patent
Lemaster et al.

(10) Patent No.: US 7,324,771 B2
(45) Date of Patent: Jan. 29, 2008

(54) METHOD FOR MINIMIZING TEMPERATURE DROOP IN A FUSER

(75) Inventors: John Lemaster, Lexington, KY (US); Calvin D. Murphy, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 343 days.

(21) Appl. No.: 11/217,055

(22) Filed: Aug. 31, 2005

(65) Prior Publication Data

US 2007/0047990 A1 Mar. 1, 2007

(51) Int. Cl.
*G03G 15/20* (2006.01)

(52) U.S. Cl. ..... 399/69; 399/70

(58) Field of Classification Search ..... 399/69, 399/70

See application file for complete search history.

(56) References Cited

U.S. PATENT DOCUMENTS 4,385,826 A 5/1983 Itoh
5,164,570 A * 11/1992 Okimura ..... 219/216
5,504,567 A 4/1996 Satoh et al.
6,927,368 B2 8/2005 Cao et al.
2004/0131375 A1* 7/2004 Lee ..... 399/69
2005/0191076 A1* 9/2005 Dan ..... 399/70

* cited by examiner

*Primary Examiner*—David M. Gray
*Assistant Examiner*—Ryan D. Walsh
(74) *Attorney, Agent, or Firm*—Stevens & Showalter, L.L.P.

(57) ABSTRACT

A method of controlling a fuser assembly within an image forming apparatus having a fuser assembly including a heating member and a backup member cooperating with the heating member to form a nip therebetween for fusing images onto substrates passing through the nip. The method is provided to minimize or avoid a temperature droop condition of the fuser and includes the steps of determining a set point temperature for performing a fusing operation, and determining whether the image forming apparatus has transitioned from a standby mode to a print mode upon receipt of a print job. If a sensed temperature of the fuser is within a temperature range having an upper threshold temperature that is less than the heating temperature and greater than the set point temperature or a lower threshold temperature, a power control for the fuser is switched to operate in a high power region, increasing power to the fuser, to provide heat energy to the heating member.

21 Claims, 5 Drawing Sheets

METHOD FOR MINIMIZING TEMPERATURE DROOP IN A FUSER

BACKGROUND OF THE INVENTION

1. Field of the Invention

The present invention relates to a method for controlling a fusing operation and, more particularly, to a method including a control algorithm for minimizing temperature droop of a fuser at the beginning of a fusing operation.

2. Related Prior Art

In an electrophotographic image forming apparatus, such as a printer or copier, a latent image is formed on a light sensitive drum and developed with toner. The toner image is then transferred onto media, such as sheets of paper, and is subsequently passed through a fuser where heat and pressure are applied to melt and adhere the unfused toner to the surface of the media. There are a variety of devices to apply heat and pressure to the media such as radiant fusing, convection fusing, and contact fusing. Contact fusing typically comprises cooperating nip forming members including a heating member and a backup member, where the heating member may comprise a halogen lamp, an inductive heater or a ceramic heater. Fusers including inductive heaters and ceramic heaters generally include a belt backup member comprising a thin belt and a backup roll, and have a very low thermal mass between the heater and the paper conveyed through the fuser. Such fusing systems are generally capable of being heated relatively quickly from room temperature to a fusing temperature, and are capable of responding quickly to sudden changes in temperature during operation of the fuser.

Halogen lamp fusers generally include a hot roller cooperating with a backup roller to form a nip through which the toned media passes. The hot roller may comprise a metal core with a conductive rubber coating surrounded by a PFA or PTFE sleeve and a halogen lamp located inside the metal core. In order to minimize the cost of the fuser, it is desirable to provide the backup roller as an unheated roller. A temperature sensor may be located in contact with an outer surface of the hot roller to provide a temperature signal for controlling the temperature of the fusing operation to a predetermined target or set point temperature.

At the beginning of a print job, the hot roller may rotate against the backup roller causing an initial transfer of heat energy from the hot roller to the backup roller until the backup roller reaches an elevated temperature. The rotation of the rollers at the beginning of a print job may be a continuation of rotation of the rollers following a previous print job, or may occur following a stationary condition of the rollers. Due to a relatively large thermal mass associated with the hot roller, i.e., a high thermal mass in comparison to that of inductive and ceramic heater fusers, energy provided from the halogen lamp in response to a drop in temperature, as detected by the temperature sensor, will not reach the outer surface of the hot roller before a substantial temperature decrease or droop of the hot roller has occurred. For example, heat energy traveling from the interior of the hot roller may take 5 to 10 seconds to reach the outer surface of the hot roller. During initial printing of the first 2 to 3 pages of a print job, during which heat is removed from the hot roller by both the backup roller and substrates, the surface temperature of the hot roller may droop 5° C. to 10° C., potentially resulting in poor fuse grade of the toned images at the beginning of the print job, where the droop in surface temperature will typically be greater when rotation of the rollers is started from a stationary condition.

Further, the thermal mass of the hot roller may cause a delay in sensing the heat energy present in the hot roller, where sufficient heat energy to warm the surface of the hot roller to the target temperature may be present in the hot roller but undetected by the temperature sensor, resulting in extended application of power to the halogen lamp leading to a temperature overshoot, heating the hot roller substantially above the target temperature. A temperature overshoot condition may adversely affect the quality of the toned images, such as by causing toner offset, and additionally may result in a structural failure of the hot roller such as delamination of the rubber coating from the hot roller core.

Accordingly, there continues to be a need for a method for accurately controlling a two-roller single lamp fuser to a target temperature in a minimum amount of time, while minimizing the effects of thermal mass of the fuser rollers, including temperature droop and temperature overshoot at the beginning of a print job.

SUMMARY OF THE INVENTION

In accordance with one aspect of the invention, a method of controlling a fuser assembly within an image forming apparatus is provided, the fuser assembly including a heating member, a backup member cooperating with the heating member to form a nip therebetween for fusing images onto substrates passing through the nip. The method comprises the steps of determining a set point temperature for performing a fusing operation; determining that the image forming apparatus has transitioned from a standby mode to a print mode; defining a heating temperature greater than the set point temperature and setting the heating temperature as a target temperature for heating the fuser; switching a power control for the fuser to operate in a high power region, increasing power to the fuser, at a first power level to heat the fuser toward the heating temperature; and setting the target temperature to the set point temperature if one of the following has occurred: a) a sensed temperature of the fuser reaches the heating temperature; b) a predetermined time period has elapsed following switching the power control to operate in the high power region; or c) the power control for the fuser has been maintained to operate in the high power region for a selected time period and the sensed temperature has increased a predetermined increment from a sensed temperature measured at the time of the switching to operate in the high power region.

In accordance with another aspect of the invention, a method of controlling a fuser assembly within an image forming apparatus is provided, the fuser assembly including a heating member, a backup member cooperating with the heating member to form a nip therebetween for fusing images onto substrates passing through the nip. The method comprises the steps of determining a set point temperature for performing a fusing operation; determining if the image forming apparatus has transitioned from a standby mode to a print mode; defining a heating temperature greater than the set point temperature; and switching a power control for the fuser to operate in a high power region, increasing power to the fuser, if a sensed temperature of the fuser is within a temperature range having an upper threshold temperature that is less than the heating temperature and greater than the set point temperature or a lower threshold temperature.

In accordance with a further aspect of the invention, a fuser assembly within an image forming apparatus is provided. The fuser assembly comprises a hot roller comprising a heating lamp; a backup roller cooperating with the hot roller to form a nip therebetween for fusing images onto substrates passing through the nip; a temperature sensor located at the hot roller for providing a sensed fuser temperature; and processing structure for controlling power to the heating lamp, the processing structure determining a set point temperature for performing a fusing operation, defining a heating temperature greater than the set point temperature, determining if the image forming apparatus has transitioned from a standby mode to a print mode and controlling the fuser to operate in a high power region, increasing power to the fuser, to heat the hot roller toward the heating temperature if a sensed temperature of the fuser is within a temperature range having an upper threshold temperature that is less than the heating temperature and greater than the set point temperature or a lower threshold temperature.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
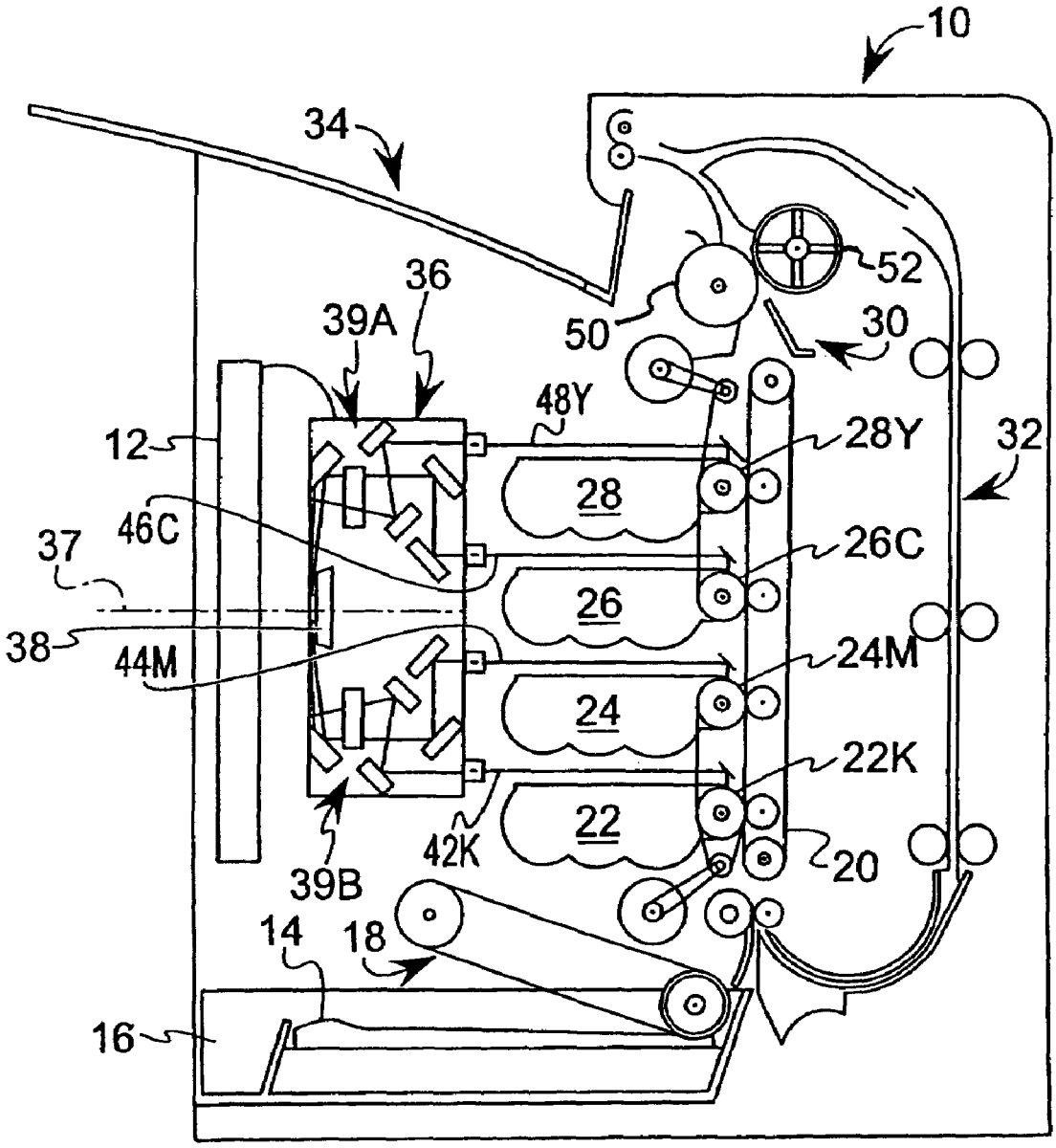
FIG. 1 is a schematic illustration of an electrophotographic printer in which the process of the present invention may be implemented.

FIG. 1 depicts a representative electrophotographic image forming apparatus, such as a color laser printer, which is indicated generally by the numeral 10. An image to be printed is electronically transmitted to a print engine controller or processor 12 by an external device (not shown) or may comprise an image stored in a memory of the processor 12. The processor 12 includes system memory, one or more processors, and other logic necessary to control the functions of electrophotographic imaging.

In performing a printing operation, the processor 12 initiates an imaging operation where a top substrate 14 of a stack of media is picked up from a media tray 16 by a pick mechanism 18 and is delivered to a media transport belt 20. The media transport belt 20 carries the substrate 14 past each of four image forming stations 22, 24, 26, 28, which apply toner to the substrate 14. The image forming station 22 includes a photoconductive drum 22K that delivers black toner to the substrate 14 in a pattern corresponding to a black image plane of the image being printed. The image forming station 24 includes a photoconductive drum 24M that delivers magenta toner to the substrate 14 in a pattern corresponding to the magenta image plane of the image being printed. The image forming station 26 includes a photoconductive drum 26C that delivers cyan toner to the substrate 14 in a pattern corresponding to the cyan image plane of the image being printed. The image forming station 28 includes a photoconductive drum 28Y that delivers yellow toner to the substrate 14 in a pattern corresponding to the yellow image plane of the image being printed. The processor 12 regulates the speed of the media transport belt 20, media pick timing and the timing of the image forming stations 22, 24, 26, 28 to effect proper registration and alignment of the different image planes to the substrate 14.

The media transport belt 20 then carries the substrate 14 with the unfused toner image superposed thereon to a fuser assembly 30, which applies heat and pressure to the substrate 14 so as to promote adhesion of the toner thereto. Upon exiting the fuser assembly 30, the substrate 14 is either fed into a duplexing path 32 for performing a duplex printing operation on a second surface of the substrate 14, or the substrate 14 is conveyed from the apparatus 10 to an output tray 34.

To effect the imaging operation, the processor 12 manipulates and converts data defining each of the KMCY image planes into separate corresponding laser pulse video signals, and the video signals are then communicated to a printhead 36. The printhead 36 includes four laser light sources (not shown) and a single polygonal mirror 38 supported for rotation about a rotational axis 37, and post-scan optical systems 39A and 39B receiving the light beams emitted from the laser light sources. Each laser of the laser light sources emits a respective laser beam 42K, 44M, 46C, 48Y each of which is reflected off the rotating polygonal mirror 38 and is directed towards a corresponding one of the photoconductive drums 22K, 24M, 26C and 28Y by select lenses and mirrors in the post-scan optical systems 39A, 39B.

Figure 2:
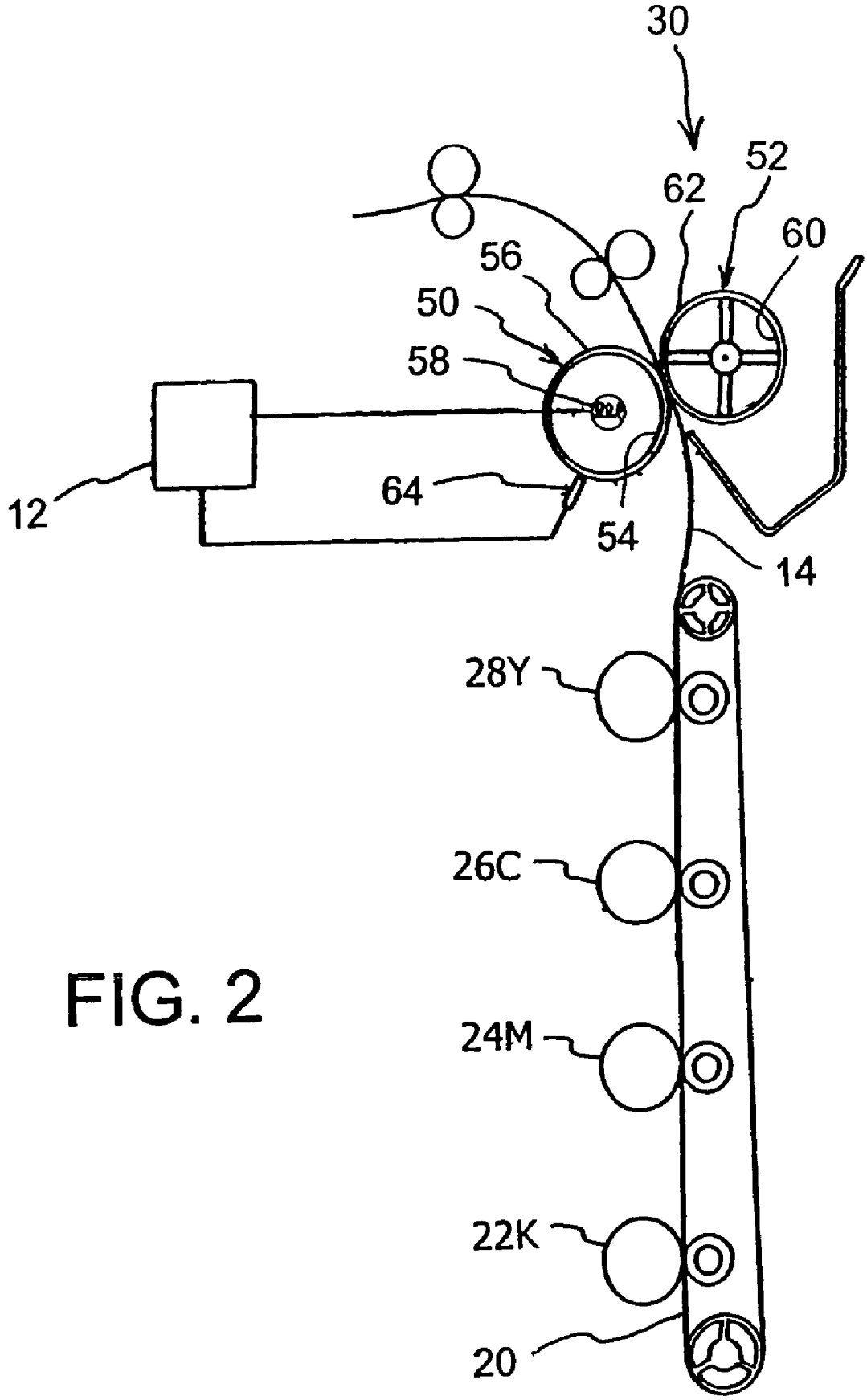
FIG. 2 is a schematic side view of a portion of the paper transport assembly, fuser assembly and electrical circuit of the electrophotographic printer shown in FIG. 1.

Referring to FIG. 2, the fuser assembly 30 in the illustrated embodiment includes a fuser hot roller 50 or fusing roller defining a heating member, and a backup roller 52 cooperating with the hot roller 50 to define a nip for conveying substrates 14 therebetween. The hot roller 50 may comprise a hollow metal core member 54 covered with a thermally conductive elastomeric material layer 56. For example the hollow metal core may comprise an aluminum core having an outer diameter of approximately 32.5 mm and a thickness of approximately 2.0 mm. The hot roller 50 may also include a PFA (polyperfluoroalkoxy-tetrafluoroethylene) sleeve (not shown) around its elastomeric material layer 56, and the outer diameter of the hot roller may be approximately 36 mm. A heater element 58, such as a halogen tungsten-filament heater, may be located inside the core 54 of the hot roller 50 for providing heat energy to the hot roller 50 under control of the processor 12. The heater element 58 may comprise a filament that provides an end boost along a predetermined portion adjacent each end of the heater element 58 to provide a greater heat output adjacent the ends than at a central portion of the heater element 58.

The backup roller 52 may comprise an extruded metal core member 60 covered with a thermally non-conductive elastomeric material layer 62. For example, the extruded metal core 60 of the backup roller 52 may comprise an aluminum core having an outer diameter of approximately 32.5 mm and a thickness of approximately 1.5 mm. The backup roller 52 may also include a PFA (polyperfluoroalkoxy-tetrafluoroethylene) sleeve (not shown) around its elastomeric material layer 62, and the outer diameter of the backup roller 52 may be approximately 36 mm. The backup roller 52 preferably comprises an unheated member.

It should be understood that the illustrated embodiment is not limited to a particular mechanism or structure for heating the hot roller 50 and that any known means of heating a roller may be implemented within the scope of this invention. In addition, a temperature sensor 64, see FIG. 2, may be provided adjacent the hot roller 50 for sensing a temperature of the hot roller 50 and for sending corresponding signals to the processor 12. The temperature sensor 64 may comprise, but is not limited to, a thermistor located in contact with the outer surface of the hot roller 50.

The processor 12 may control AC power to the heater element 58 using a dual pulse width modulation (PWM) control. The PWM control may include one of a plurality of power waveforms, as selected by a waveform PWM control signal. Each power waveform defines a first modulated power waveform and is defined by a waveform length and a waveform power segment, the waveform length comprising a predetermined number of half cycles and the waveform power segment comprising a selected number of the half cycles of the waveform length during which power is supplied to the heater element 58. By way of example, a waveform length of three half cycles may be defined, providing three discrete power levels that are periodically repeated on a period of three half cycle segments of the cyclical AC power. Thus, three power waveforms provide three levels comprising: 1) a one-out-of-three half cycle power waveform, where power is supplied to the heater element one-out-of-three half cycles to provide one third power; 2) a two-out-of-three half cycle power waveform, where power is supplied two-out-of-three half cycles to provide two thirds power, and; 3) a three-out-of-three half cycle power waveform, where power is supplied three-out-of-three half cycles to provide full power. Power switching for applying power during the selected number of half cycles takes place at zero cross-over points as may be controlled by a zero-cross optoisolator triac drive circuit (not shown). Depending upon the mode of operation, i.e., print, standby or warm up, and the temperature of the hot roller 50 relative to a target temperature, power may be supplied to the heater element 58 in accordance with one of the three power waveforms and at a rate determined by a selected duty cycle power control or percentage of a selected time period, as selected by a duty cycle PWM control signal that defines a second modulated power level. A target temperature may comprise a temperature to which the sensed temperature of the hot roller 50 is controlled during operation of the fuser assembly 30 in the print, standby and warm up modes of operation. Further description of the operation of a dual PWM control may be found in U.S. Pat. No. 6,927,368, the disclosure of which is incorporated herein by reference.

The processor 12 applies the dual PWM power control to supply power to the heater element 58 for maintaining a sensed temperature of the hot roller 58 at a predetermined target temperature during the standby and print modes of operation. The printer 10 is in a standby mode when the printer 10 has warmed up to a predetermined standby temperature after initially being turned on or transfers to the standby mode for a predetermined time period immediately after completion of a print job, wherein the temperature of the hot roller 50 is maintained at the predetermined standby temperature. In the embodiment described herein, the standby temperature may be approximately 168° C. Power to the heater element 58 may be turned off in a power saver mode when the printer 10 has not printed a print job for a predetermined period of time. A print job may comprise the printing of a single substrate or the continuous printing of two or more substrates of the same type, at the same nominal production rate and at the same hot roller temperature.

At the beginning of a print job, the processor 12 determines a set point temperature for performing the fusing operation. The set point temperature may be determined on the basis of the media type, roughness and weight, and/or the process speed (resolution) for the printing operation. For example, in the embodiment described herein, plain paper heavy media printed at a process speed of 20 ppm may have a set point temperature of approximately 171° C.; 20 pound paper printed at a process speed of 20 pages/minute (ppm) may have a set point temperature of approximately 155° C. to 165° C.; 20 pound paper printed at a process speed of 10 ppm may have a set point temperature of approximately 145° C. to 165° C.; and transparencies printed at a process speed of 6 ppm may have a set point temperature of approximately 155° C. to 165° C.

For the purposes of the following explanation, power regions are defined for application of particular power levels and power outputs of the heater element 58 wherein a high power region is triggered when the temperature of the hot roller 50 is below a target temperature for the hot roller 50, and a low power region is triggered when the temperature of the hot roller 50 is above a target temperature for the hot roller 50. Application of a power control in a low power region comprises a power application permitting the temperature of the hot roller 50 to decrease, and application of power in a high power region comprises an application of power sufficient to cause an increase in the temperature of the hot roller 50.

During normal PWM control of power to the heater element 58 in a print mode of operation, when the sensed temperature of the hot roller 50 exceeds the set point temperature, i.e., the target set point temperature for a fusing operation, the processor 12 switches the power control to a low power region where a zero-out-of-three power waveform may be applied with a 0% duty cycle, i.e., heater element power off, decreasing power to the heater element 58 to cause the hot roller 50 to cool. When the temperature of the hot roller 50 is below the set point temperature, the processor 12 switches the power control to operate in a high power region to cause an increased power, such as the two-out-of-three power waveform, to be applied to the heater element 58. Power may be applied to the heater element 58 during the print mode using a period of 10 seconds and a duty cycle power control of approximately 96% to cause the hot roller 50 to heat up.

During the standby mode of operation, when the sensed temperature of the hot roller 50 exceeds the target standby temperature, i.e., 168° C., the processor 12 switches the power control to a low power region where a zero-out-of-three power waveform may be applied with a 0% duty cycle, i.e., heater element power off, decreasing power to the heater element 58 to cause the hot roller 50 to cool. When the temperature of the hot roller 50 is below the target standby temperature, the processor 12 switches the power control to operate in a high power region to cause an increased power, such as the one-out-of-three waveform, to be applied to the heater element 58. Power may be applied to the heater element 58 during the standby mode using a period of 10 seconds and a duty cycle power control of approximately 100% to cause the hot roller 50 to heat up.

It should be noted that power control in the low power region is not limited to turning off power to the heater element 58, and that a power application in the low power region may comprise an application of power sufficiently low to allow the temperature of the hot roller 50 to decrease, as well as application of no power.

When the printer 10 switches from the standby mode to the print mode of operation, such as in response to receipt of a print job, the hot roller 58 may experience a sudden drop in temperature during printing of the initial substrates of the print job, i.e., during the first three substrates of the print job, if the power to the heater element 58 is controlled as described above for controlling the hot roller 50 to a set point temperature for the print mode. This temperature drop may result from an insufficient temperature gradient being established through the hot roller 50 to offset the heat energy extracted from the hot roller 50 by the substrates. Specifically, it may take approximately 8 seconds for heat from the interior of the hot roller 50 to travel outwardly from the heater element 58 to the exterior of the hot roller 50, such that a delay may occur between the time that a temperature drop is sensed by the temperature sensor 64 and the time that sufficient heat energy to compensate for the temperature drop arrives at the outer surface of the hot roller 50. In order for the hot roller temperature to be maintained during the beginning of a print job, additional energy must be provided to compensate for the heat energy transferred to the substrates. Additional heat energy may also be lost to the backup roller 52 as the hot roller 50 and backup roller 52 begin to rotate together at the beginning of the print job. In accordance with the embodiment of the invention described further below, the heater element 58 may be controlled in such a manner as to be turned on early to provide additional power to the heater element 58 than may be provided during normal PWM control in the print mode of operation to thereby establish a sufficient temperature gradient through the hot roller 50 for maintaining the set point temperature.

Figure 3A:
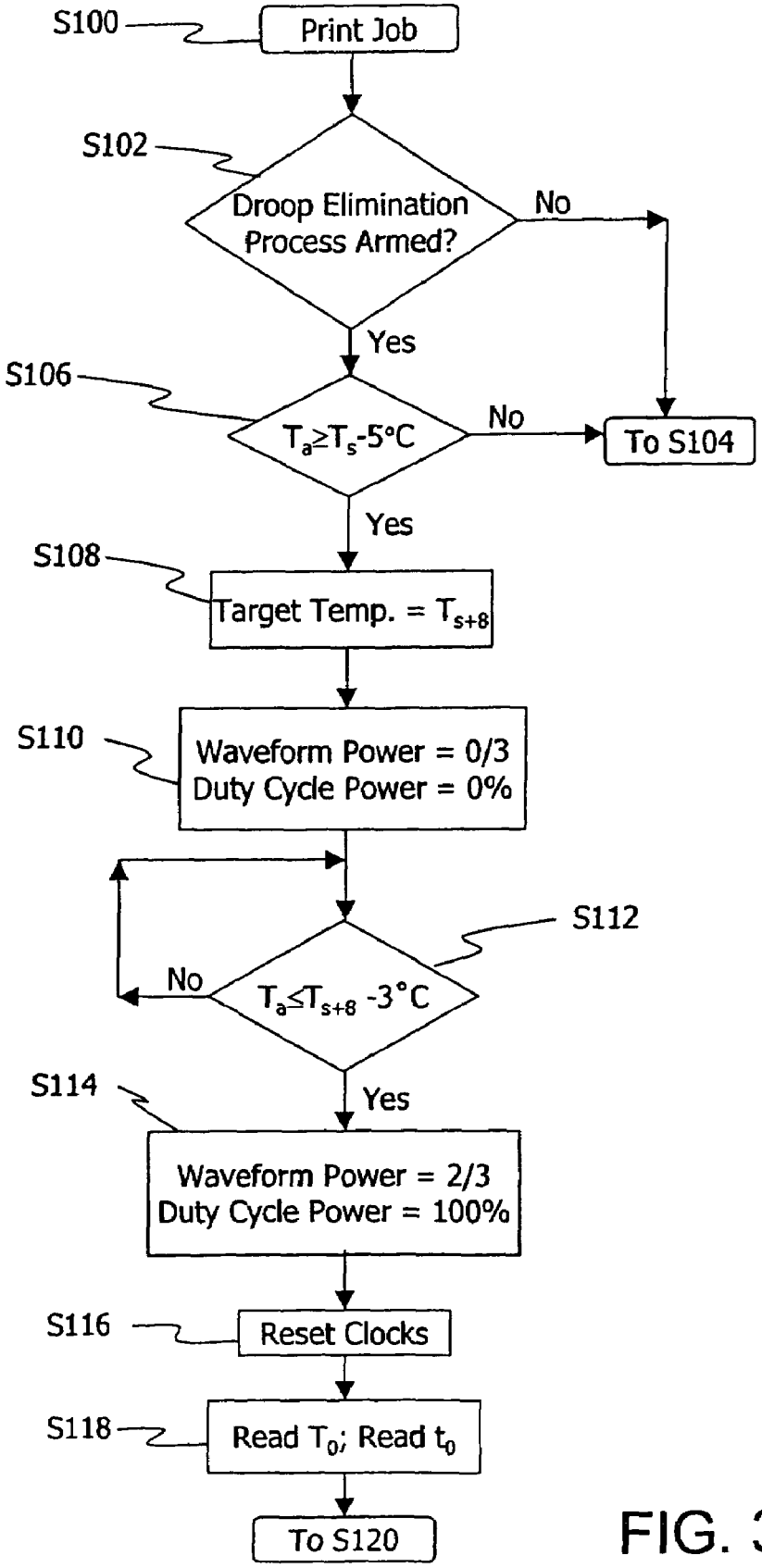
FIGS. 3A and 3B are flowcharts depicting an embodiment illustrating the invention.
Figure 3B:
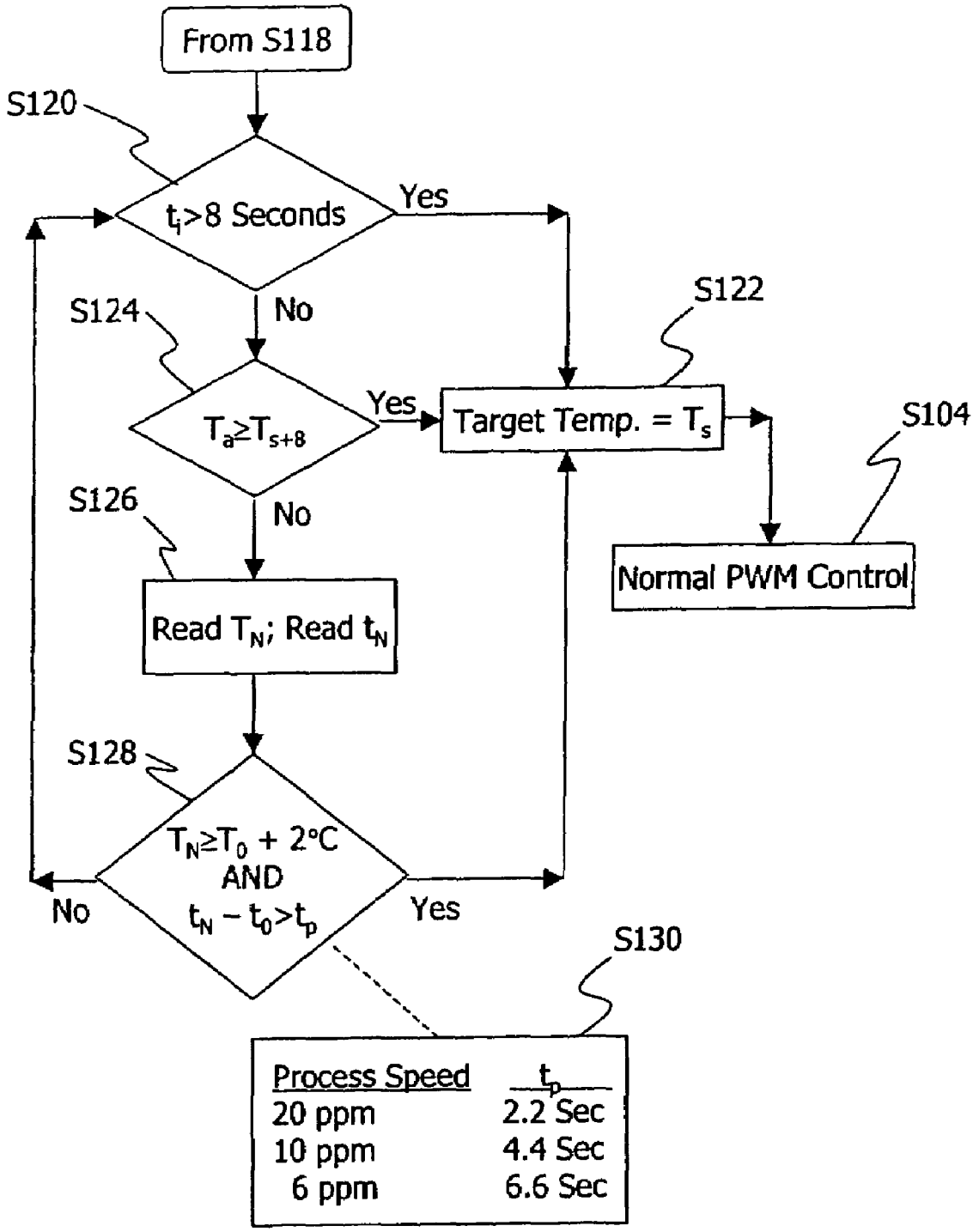

FIGS. 3A and 3B are flowcharts depicting process steps implemented by the processor 12 in accordance with a droop elimination algorithm comprising a process for eliminating or reducing a temperature drop or droop at the beginning of a print job received by the printer 10 when the printer 10 is in the standby mode. Referring initially to FIG. 3A and beginning at step S100, a print job is received by the printer 10, the processor 12 determines a print set point temperature, $T_s$, for the print job, and whether the droop elimination process has been armed at step S102. The droop elimination process will be armed if the printer 10 is in the standby mode after the printer 10 has warmed up after being turned on. The droop elimination process will also be armed if the printer 10 is in the standby mode following processing of a print job and a printer run out process has ended, where the printer runout process comprises termination of drive power to the print head 36, the transport belt 20 and the image forming stations 22, 24, 26, 28, including termination of EP voltages for toner transfer operations at the image forming stations 22, 24, 26, 28. If the droop elimination process is not armed, the process proceeds to step S104 for controlling power to the heater element 58 in accordance with the normal PWM control for a print operation, as described above.

After the droop elimination process is armed, the process proceeds to step S106 where a sensed or actual temperature reading, $T_a$, is taken from the temperature sensor 64 and compared to a lower threshold temperature $T_1$. The lower threshold temperature $T_1$ comprises a temperature determined with reference to the set point temperature, $T_s$, and in the present embodiment comprises a temperature that is 5° C. less than the set point temperature, $T_s$, i.e., $T_1=T_s-5°$ C., see also FIG. 4. If the sensed temperature, $T_a$, is less than the lower threshold temperature $T_1$, then the process proceeds to step S104 to resume the normal PWM control, see FIG. 3B.

It may be noted that if the sensed temperature, $T_a$, is less than the lower threshold temperature $T_1$, the printer 10 may delay processing of the print job until the temperature of the hot roller 50 is closer to the set point temperature, $T_s$, and a predetermined power level will be applied to the fuser using a predetermined PWM control. For example, a two-out-of-three power waveform may be applied with a 96% duty cycle until the hot roller temperature reaches the set point temperature, $T_s$. Subsequently, the hot roller temperature is maintained at the set point temperature, $T_s$, using the normal PWM control for a print operation.

If the sensed temperature, $T_a$, is greater than the lower threshold temperature $T_1$, then the process proceeds to step S108 where target temperature for the droop elimination process is set to a temperature greater than the set point temperature, $T_s$. For clarity in the present discussion the new target temperature is defined as a heating temperature, $T_{s+8}$. In the described embodiment, the heating temperature is determined with reference to the set point temperature, $T_s$, and comprises a temperature 8° C. greater than the set point temperature, $T_s$, i.e., $T_{s+8}=T_s+8°$ C., see also FIG. 4.

The process then continues to step S110 where the power control is switched to operate in a low power region, decreasing power to the heater element 58 of the hot roller 50. In the described embodiment, the operation of the heater element 58 low power region comprises application of a zero-out-of-three power waveform applied with a 0% duty cycle, i.e., heater element power off.

The process next proceeds to step S112 where sensed temperature, $T_a$, is compared to an upper threshold temperature, $T_2$, that is a temperature that is less than the heating temperature, $T_{s+8}$, and greater than the set point temperature, $T_s$. In the present embodiment, the upper threshold temperature, $T_2$, comprises a temperature that is 3° C. less than the heating temperature, $T_{s+8}$, i.e., $T_2=T_{s+8}-3°$ C., see also FIG. 4. Hence, the upper threshold temperature, $T_2$, is 5° C. greater than the set point temperature, $T_s$. If the sensed temperature, $T_a$, is greater than the upper threshold temperature $T_2$, then the process remains at step S112 and continues to check the sensed temperature, $T_a$. If the sensed temperature, $T_a$, is less than or equal to the upper threshold temperature $T_2$, then the process continues to step S114.

In step S114, the power control is switched to operate in a high power region, increasing power to the heater element 58 of the hot roller 50. In the described embodiment, the operation of the heater element 58 in the high power region comprises application of a two-out-of-three power waveform applied with a 100% duty cycle. It may be noted that the application of power in the high power region of the droop elimination process provides a higher power input to the heater element 58 than the application of power to maintain the hot roller 50 at the set point temperature in the high power region of the normal PWM control for the printing operation. Specifically, the high power region of the droop elimination process applies approximately 67%, i.e., ⅔×100%, of full power to the heater element 58, whereas the high power region of the normal PWM control for the printing operation provides approximately 64%, i.e., ⅔×96%, of full power to the heater element 58.

It may be noted that step S112 operates to limit power application at step S114, where power application in the high power region of operation is prevented when the sensed temperature, $T_a$, is within a range of measurement variation that may occur due to electrical interference and/or due to temperature fluctuations on the surface of the hot roller 50. Hence, the upper threshold temperature, $T_2$, ensures that heat is not applied to the hot roller 50 when the temperature of the hot roller 50 is close to the heating temperature, $T_{s+8}$, where additional heat may result in a temperature overshoot condition.

Subsequent to step S114, the process resets first and second clocks in the processor 12 at step S116 for measuring time periods from the time at which power is switched to the high power region. The process then reads an initial temperature, $T_0$, from the temperature sensor 64 and reads an initial time, to, at step S118. Referring to FIG. 3B, the process then proceeds to step S120 where a time, $t_t$, obtained from the first clock is compared to a predetermined time. In the described embodiment, the predetermined time comprises 8 seconds, and is selected based on the estimated time required for heat energy to travel from the interior of the hot roller core 54 to the exterior surface of the hot roller 50. If the time, $t_t$, is greater than 8 seconds, the process goes to step S122 where the target temperature is reset to the set point temperature, $T_s$, and the process exits the droop elimination process, continuing to step S104 to control power supplied to the heater element 58 in accordance with the normal PWM control for the printer operation.

If the time, $t_t$, measured by the first clock is not greater than 8 seconds at step S120, the process proceeds to step S124 where the sensed temperature, $T_a$, is compared to the heating temperature, $T_{s+8}$. If the sensed temperature, $T_a$, is greater than or equal to the heating temperature, $T_{s+8}$, the process proceeds to step S122 to reset the target temperature to the set point temperature, $T_s$, and then exits the droop elimination process continuing to step S104.

If the sensed temperature, $T_a$, is less than the heating temperature, $T_{s+8}$, the process proceeds to step S126 to read a current time, $t_N$, from the second clock and to read a value of sensed temperature, $T_a$, at time $t_N$, and identified in FIG. 3B as a current temperature, $T_N$. The process then proceeds to step S128 where a determination is made whether a predetermined temperature condition has been met at a selected predetermined time after switching the power control to operate in the high power region. Specifically, the process at step S128 checks to determine whether the current temperature $T_N$ is greater than or equal to the initial temperature, To, plus 2° C. and the difference between the current time, $t_N$, and the initial time, $t_0$, is greater than a value, $t_p$, related to the process speed, as determined from a table S130. The table S130 lists time values, $t_p$, corresponding to process speeds of 6 ppm, 10 ppm and 20 ppm, where each time value, $t_p$, comprises the estimated time for the hot roller 50 to make two revolutions at the given process speed. That is, the hot roller 50 will make two revolutions in approximately 2.2 seconds at a process speed of 20 ppm; the hot roller 50 will make two revolutions in approximately 4.4 seconds at a process speed of 10 ppm; and the hot roller 50 will make two revolutions in approximately 6.6 seconds at a process speed of 6 ppm. The 2° C. increase in the temperature of the hot roller 50 over the selected time period is considered a sufficient time for heat energy from the interior of the hot roller 50 to travel to the outer surface and for a sufficient temperature gradient to be established through the hot roller 50 for the hot roller 50 to be maintained at the set point temperature, $T_s$. In addition, the time condition applied in step S128, providing for two revolutions of the hot roller 50, is considered to ensure that the temperature around the circumference of the hot roller 50 is substantially uniform. That is, rotation of the rollers 50, 52 for two revolutions is considered sufficient to eliminate hot spots that may have occurred while the rollers 50, 52 were stationary in the standby mode.

If the conditions of step S128 are met, then the process proceeds to step S122 to reset the target temperature to the set point temperature, $T_s$, and then exits the droop elimination process continuing to step S104. If the conditions of step S128 are not met, then power continues to be applied to the heating lamp 58 and the process returns to step S120.

The above described droop elimination process continues to apply power until one of the conditions of steps S120, S124 and S128 are met. Each of the conditions of steps S120, S124 and S128 are considered to indicate that heat energy provided from heating lamp 58 has traveled from the interior to the exterior of the hot roller 50, while also limiting application of power in the droop elimination process to avoid a temperature overshoot condition.

Also, at the conclusion of a print job, the hot roller 50 and backup roller 52 continue to rotate together for a predetermined period of time, i.e. 15 seconds, to dissipate heat energy from the hot roller 50 and thereby limit the temperature overshoot that may occur when paper no longer passes through the fuser nip. For example, the continued rotation of the hot roller 50 and backup roller 52 may limit the temperature overshoot to approximately 7° C. to 10° C. above the target temperature. The continued rotation of the rollers 50, 52 at the end of print job is not considered part of the printer runout operation described above in relation to arming the droop elimination process. Hence, it is possible for the droop elimination process to be armed for processing of a subsequent print job prior to rotation of the fuser rollers 50, 52 being terminated.

The present droop elimination process operates to provide an anticipated amount of heat to the hot roller 50 prior to a sensed need for the added heat in order to reduce the temperature droop effect resulting from a lag between power application and the heating of the outer surface of the hot roller 50. That is, by setting the target temperature at an elevated heating temperature, $T_{s+8}$, power may be provided to heat the hot roller 50 even when the temperature of the hot roller 50 is at or above the set point temperature for the print job, thereby providing additional heat energy to establish a temperature gradient through the hot roller 50 for maintaining the temperature of the hot roller 50 as initial substrates of a print job are processed. Also, the application of power to the heating element 58 may be started as soon as the printer 10 begins a new print job in transitioning from the standby mode and when the temperature of the hot roller 50 is within the temperature range between the lower threshold temperature, $T_1$ and upper threshold temperature, $T_2$, such that the hot roller 50 may be heated by the droop elimination process substantially before a first page of the job arrives at the fuser 30.

It may also be noted that the described droop elimination process provides less than full power to the heating element 58. While application of full power may decrease the temperature droop, the temperature overshoot associated with such a power application could result in a temperature overshoot that exceeds the maximum temperature limit for the hot roller 50. The application of power in the described embodiment for the droop elimination process provides a balance between the power applied to the hot roller 50 to compensate for temperature droop and power that may cause temperature overshoot if the heat energy provided to the hot roller 50 substantially exceeds the rate at which heat is removed from the hot roller 50.

Figure 4:
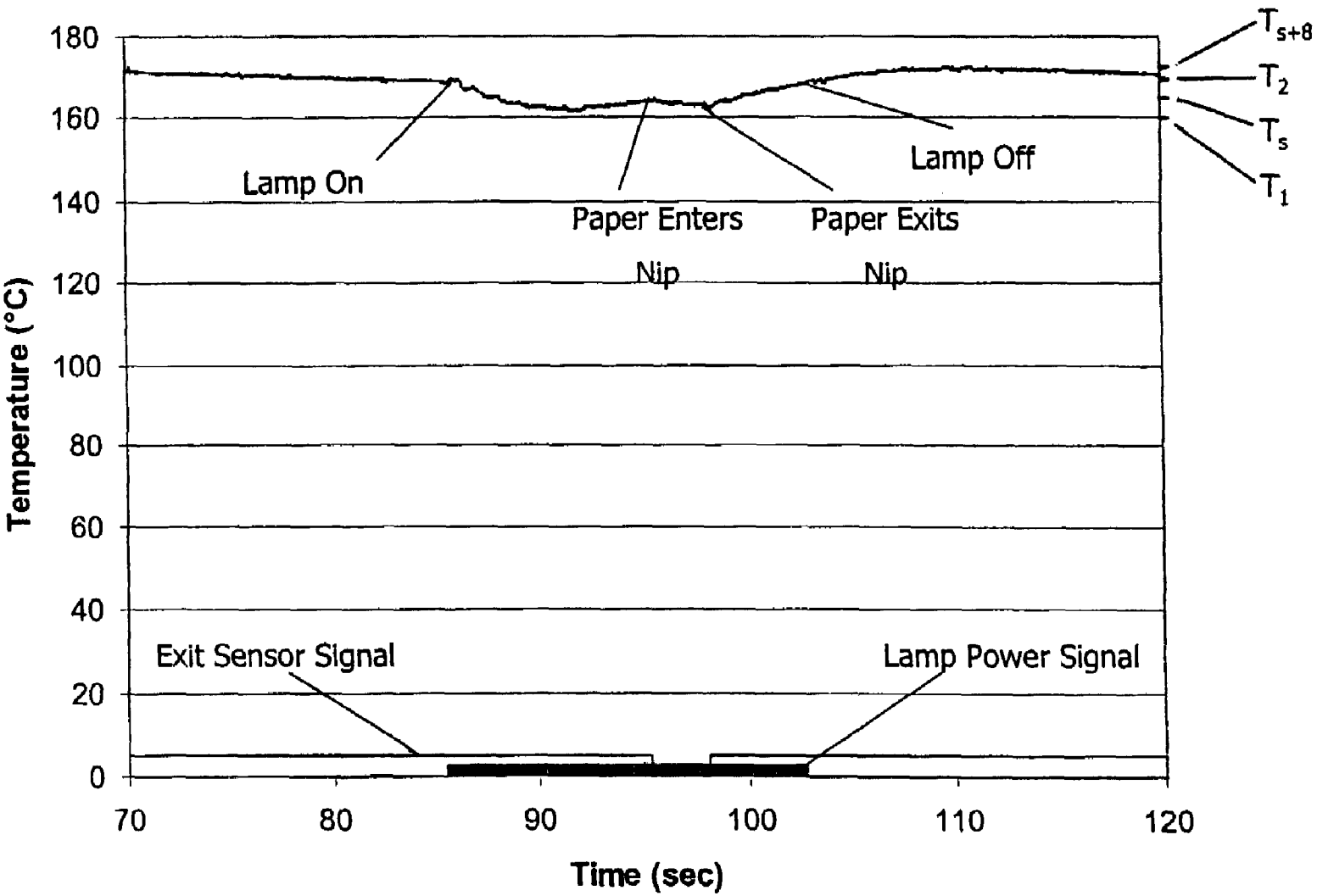
FIG. 4 is a plot illustrating the effect of the process of the present invention during a print operation.

FIG. 4 illustrates a temperature plot provided by the thermistor 64 when the printer 10 is in the standby mode and transitions to the print mode upon receipt of a print job. The plot illustrates the temperature of the hot roller 50 for a print job performed on one page of 20 pound paper printed at a process speed of 20 ppm and having a print set point temperature, $T_s$, of 165° C. Hence the heating temperature, $T_{s+8}$, is 173° C.; the lower threshold temperature, $T_1$, is 160° C.; and the upper threshold temperature, $T_2$, is 170° C. It can be seen that power is applied to heat the heating lamp 58 for a period of time prior to paper entering the fuser nip, where a line depicting a lamp power signal extending above the zero axis line of the plot indicates power application to the lamp substantially corresponding in time to the beginning of the droop elimination process. Additionally, a line depicting an exit sensor signal dropping down toward the zero axis line of the plot indicates the presence of paper for the print job passing through the fuser nip, as monitored by a sensor (not shown) located adjacent the exit side of the fuser 30.

The temperature of the hot roller 50 at the beginning of the droop elimination process is approximately the target standby temperature, i.e., approximately 168° C., which is less than the upper threshold temperature, $T_2$, such that power is provided to the heating lamp 58 with the heating temperature, $T_{s+8}$, set as the target temperature. The paper arrives at the fuser nip at a time greater than 8 seconds after the power to the heating lamp 58 begins, such that the continued application of power to the heating lamp 58 is provided in accordance with the normal PWM control for the print operation. In the present example, the temperature of the hot roller 50 is below the print set point temperature, $T_s$, when the power control exits the droop elimination process such that the power control for the heater 58 continues to be operated in the high power region, but with a slightly reduced power as compared to the power provided in the droop elimination process, during the normal PWM control. Subsequent to the paper passing the exit sensor, the fuser is controlled to the target standby temperature, such that the plot shows power being applied until the temperature of the hot roller 50 reaches approximately 168° C. It can be seen that during the time that paper is present in the nip of the fuser 30, the temperature remains within approximately 2.5° C. of the set point temperature, $T_s$, which is within an acceptable temperature range for providing satisfactory fuse grade of a toned image.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling a fuser assembly within an image forming apparatus, the fuser assembly including a heating member, a backup member cooperating with the heating member to form a nip therebetween for fusing images onto substrates passing through the nip, the method comprising the steps of:

determining a set point temperature for performing a fusing operation;

determining if said image forming apparatus has transitioned from a standby mode to a print mode;

defining a heating temperature greater than said set point temperature and setting said heating temperature as a target temperature for heating said fuser if said image forming apparatus has transitioned from said standby mode to said print mode;

switching a power control for said fuser to operate in a high power region, increasing power to said fuser, to cause power to be applied to said fuser at a first power level to heat said fuser toward said heating temperature; and setting said target temperature to said set point temperature if one of the following has occurred:

a) a sensed temperature of said fuser reaches said heating temperature;

b) a predetermined time period has elapsed following switching said power control to operate in said high power region; or c) said power control for said fuser has been maintained to operate in said high power region for a selected time period and said sensed temperature has increased a predetermined increment from a sensed temperature measured at the time of said switching to operate in said high power region.

2. The method as in claim 1 wherein said selected time period is selected from a plurality of time periods, each time period corresponding to a process speed for said fuser assembly.

3. The method as in claim 1 wherein said step of determining if said image forming apparatus has transitioned from said standby mode to said print mode comprises determining if said image forming apparatus is in said standby mode after either a warm up process or completion of a printer run out process following a print job.

4. The method of claim 3 wherein said completion of said printer run out process comprises termination of power to image forming stations of said image forming apparatus.

5. The method as in claim 1 including, prior to switching said power control to operate in said high power region, maintaining said power control for said fuser to operate in a low power region, decreasing power to said fuser, until said sensed fuser temperature is less than or equal to an upper threshold temperature that is less than said heating temperature and greater than said set point temperature.

6. The method as in claim 1 including, prior to said step of defining said heating temperature, comparing said sensed temperature to a lower threshold temperature less than said set point temperature, and setting said target temperature to said set point temperature if said sensed temperature is less than said lower threshold temperature.

7. The method as in claim 1 including, following said step of setting said target temperature to said set point temperature, applying power to said fuser at a second power level, lower than said first power level, when said sensed temperature of said fuser falls below said set point temperature.

8. The method as in claim 1 wherein said heating temperature is a predetermined increment greater than said set point temperature.

9. The method as in claim 8 wherein said set point temperature is selected from a plurality of set point temperatures corresponding to different media or process speeds.

10. A method of controlling a fuser assembly within an image forming apparatus, the fuser assembly including a heating member, a backup member cooperating with the heating member to form a nip therebetween for fusing images onto substrates passing through the nip, the method comprising the steps of:

determining a set point temperature for performing a fusing operation;

determining if said image forming apparatus has transitioned from a standby mode to a print mode;

defining a heating temperature greater than said set point temperature; and switching a power control for said fuser to operate in a high power region, increasing power to said fuser, if a sensed temperature of said fuser is within a temperature range having an upper threshold temperature that is less than said heating temperature and greater than said set point temperature or a lower threshold temperature.

11. The method as in claim 10 including switching said power control for said fuser to operate in a low power region, decreasing power to said fuser, if a sensed temperature of said fuser is greater than said upper threshold temperature.

12. The method as in claim 11 including, after said switching said power control for said fuser to operate in said low power region, switching said power control to operate in said high power region after said sensed temperature passes below said upper threshold temperature.

13. The method as in claim 10 wherein said power control for said fuser is operated in said high power region until one of the following conditions is met:

a) said sensed temperature reaches said heating temperature;

b) said power control for said fuser has been continuously operated in said high power region for a predetermined time; or c) said power control for said fuser has been continuously operated in said high power region for a selected time period and said sensed temperature has increased a predetermined increment from a sensed temperature measured at the time of switching said power control to operate in said high power region.

14. The method as in claim 13 wherein said selected time period is selected from a plurality of time periods, each time period corresponding to a process speed for said fuser assembly.

15. The method as in claim 10 wherein said heating temperature is defined with reference to said set point temperature.

16. The method as in claim 15 wherein said set point temperature is selected from a plurality of set point temperatures corresponding to different media or process speeds.

17. A fuser assembly within an image forming apparatus comprising:

a hot roller comprising a heating lamp;

a backup roller cooperating with said hot roller to form a nip therebetween for fusing images onto substrates passing through said nip;

a temperature sensor located at said hot roller for providing a sensed fuser temperature; and processing structure for controlling power to said heating lamp, said processing structure determining a set point temperature for performing a fusing operation, defining a heating temperature greater than said set point temperature, determining if said image forming apparatus has transitioned from a standby mode to a print mode and controlling said fuser to operate in a high power region, increasing power to said fuser, to heat said hot roller toward said heating temperature if a sensed temperature of said fuser is within a temperature range having an upper threshold temperature that is less than said heating temperature and greater than said set point temperature or a lower threshold temperature.

18. The apparatus as in claim 17 wherein said processing structure controls said fuser to operate in a low power region, decreasing power to said fuser, if said sensed temperature of said hot roller is greater than said upper threshold temperature.

19. The apparatus as in claim 18 wherein, after controlling said fuser to operate in said low power region, said processing structure controls said fuser to operate in said high power region after said sensed temperature of said hot roller passes below said upper threshold temperature.

20. The apparatus as in claim 17 wherein said processing structure controls said fuser to operate in said high power region until one of the following conditions is met:

a) said sensed temperature reaches said heating temperature;

b) said fuser has been continuously operated in said high power region for a predetermined time; or c) said fuser has been continuously operated in said high power region for a selected time period and said sensed temperature has increased a predetermined increment from a sensed temperature measured at the time said processing structure began to control said fuser to operate in said high power region.

21. The apparatus as in claim 20 wherein said selected time period is selected from a plurality of time periods, each time period corresponding to a process speed for said fuser assembly.

* * * * *